US008142976B2

(12) United States Patent
Yang

(10) Patent No.: US 8,142,976 B2
(45) Date of Patent: Mar. 27, 2012

(54) METHOD FOR PREPARING MULTIPLE EMULSION AND POROUS POLYMER PARTICLES THEREFROM

(75) Inventor: Xiqiang Yang, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 292 days.

(21) Appl. No.: 12/630,214

(22) Filed: Dec. 3, 2009

(65) Prior Publication Data

US 2011/0136059 A1 Jun. 9, 2011

(51) Int. Cl.
*G03G 9/135* (2006.01)

(52) U.S. Cl. ..... 430/137.17; 430/137.14; 430/137.15

(58) Field of Classification Search ..... 430/137.14, 430/137.15, 137.17
See application file for complete search history.

(56) References Cited

U.S. PATENT DOCUMENTS

| | | | | |
|---|---|---|---|---|
| 3,923,704 | A | 12/1975 | Gunning et al. | |
| 4,339,237 | A | 7/1982 | Wang et al. | |
| 4,461,849 | A | 7/1984 | Karickhoff | |
| 4,489,174 | A | 12/1984 | Karickhoff | |
| 4,833,060 | A | 5/1989 | Nair et al. | |
| 4,965,131 | A | 10/1990 | Nair et al. | |
| 7,368,212 | B2 | 5/2008 | Sugiura et al. | |
| 2008/0176157 | A1 * | 7/2008 | Nair et al. | 430/108.21 |
| 2008/0176164 | A1 | 7/2008 | Nair et al. | |

FOREIGN PATENT DOCUMENTS

| | | |
|---|---|---|
| EP | 0 083 188 | 7/1983 |

* cited by examiner

*Primary Examiner* — Peter Vajda
(74) *Attorney, Agent, or Firm* — Andrew J. Anderson

(57) ABSTRACT

A method of manufacturing a double emulsion with narrow dispersed phase particle size distribution comprising: providing an organic phase comprising solid hydrocolloid particles dispersed in an organic solvent; and dispersing the organic phase in an aqueous phase in the presence of a controlled amount of stabilizing agent to form an emulsion of droplets of the organic phase dispersed in the external aqueous phase, wherein the hydrocolloid particles in the organic phase droplets are swelled with water from the external aqueous phase to form internal droplets of an aqueous phase in the organic phase droplets, thereby forming a double emulsion comprising droplets of the organic phase of controlled narrow particle size distribution in the external aqueous phase, where the organic phase droplets contain internal droplets of an aqueous phase. A method for producing porous polymeric particles by such a double emulsion method, wherein the organic phase further comprises a polymer resin, and wherein the organic solvent is removed from the dispersed organic phase droplets to form porous toner particles.

20 Claims, 2 Drawing Sheets

Scanning Electron Microscopic image of a freeze fractured particle obtained according to Example 1.

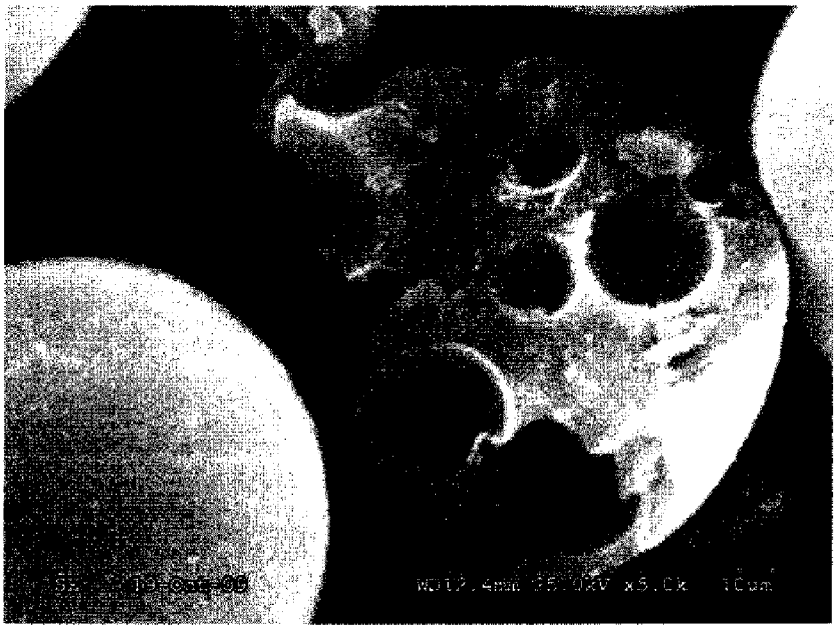
Figure 1. Scanning Electron Microscopic image of a freeze fractured particle obtained according to Example 1.
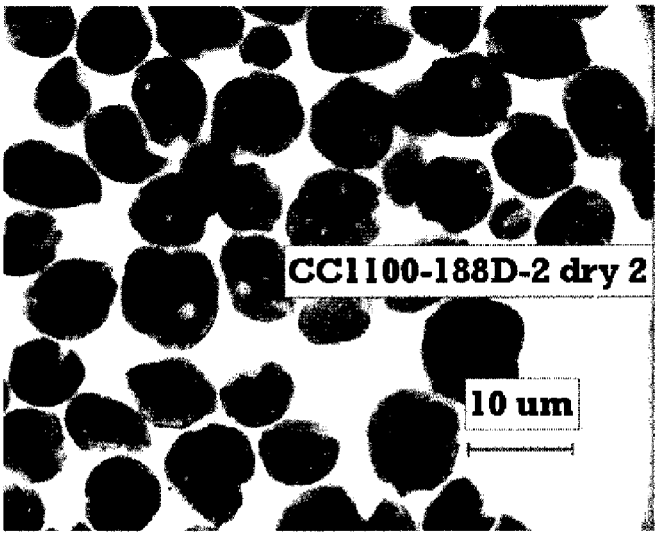
Figure 2. Optical image of a toner sample obtained according to Example 3, b).

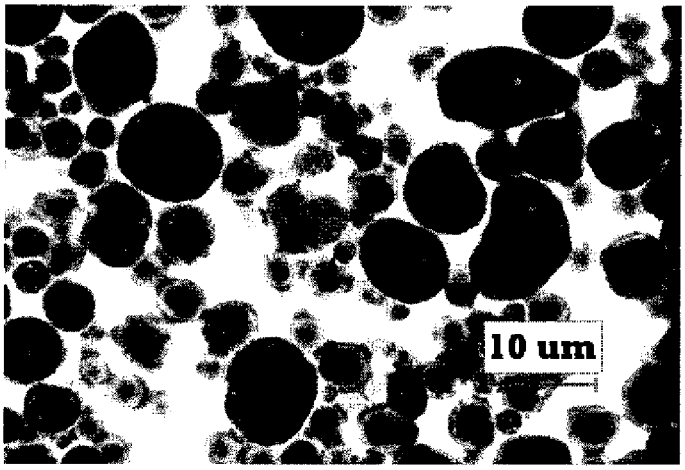
Figure 3. Optical image of a toner sample obtained according to Example 4.
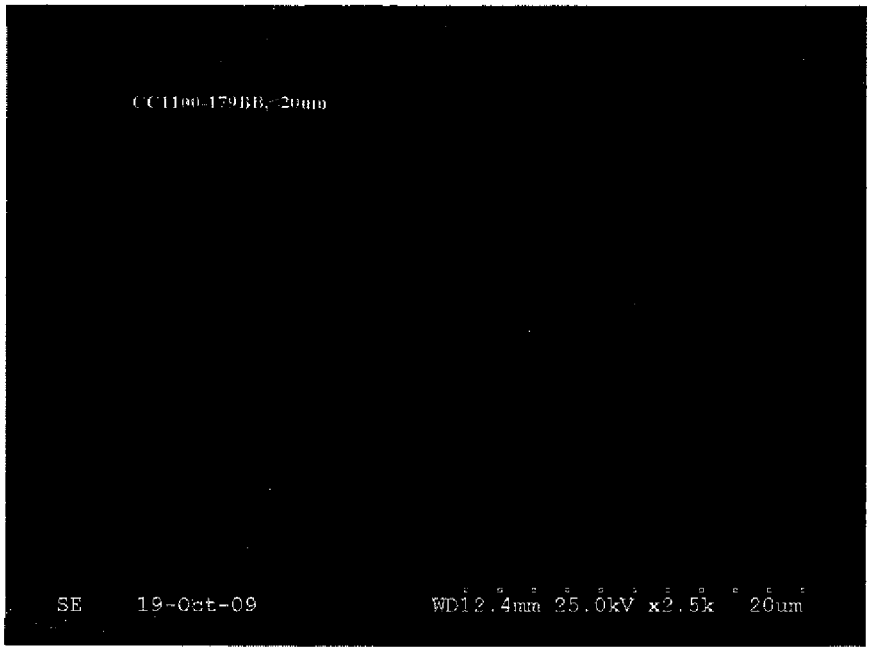
Figure 4. An SEM image of freeze fractured particle from Example 5.

METHOD FOR PREPARING MULTIPLE EMULSION AND POROUS POLYMER PARTICLES THEREFROM

FIELD OF THE INVENTION

This invention relates to a method for the preparation of water-in-oil-in-water emulsions and porous polymeric powders therefrom, and more particularly, to a method for the preparation of porous polymeric particles suitable for use as electrostatographic toners.

BACKGROUND OF THE INVENTION

Electrostatographic toners are currently manufactured through two main routes. The so-called conventional toner powders, also known as melt-pulverized (MP) toner, are made up of a binder polymer and other ingredients, such as pigment and a charge control agent, that are melt blended on a heated roll or in an extruder. The resulting solidified blend is then ground or pulverized to form a powder. Inherent in this conventional process are certain drawbacks. For example, the binder polymer must be brittle to facilitate grinding. Improved grinding can be achieved at lower molecular weight of the polymeric binder. However, low molecular weight binders have several disadvantages; they tend to form toner/developer flakes; they promote scumming of the carrier particles that are admixed with the toner powder for electrophotographic developer compositions; their low melt elasticity increases the off-set of toner to the hot fuser rollers of the electrophotographic copying apparatus, and the glass transition temperature (Tg) of the binder polymer is difficult to control. In addition, grinding of the polymer results in a wide particle size distribution. Consequently, the yield of useful toner is lower and manufacturing cost is higher. Also the toner fines accumulate in the developer station of the copying apparatus and adversely affect the developer life.

The more recent and more desirable method for toner preparation is the chemically prepared toner (CPT) technique. Both toner particle size and size distribution can be more effectively controlled through various CPT technologies. The preparation of toner polymer powders from a preformed polymer by a chemically prepared toner process, known as the "evaporative limited coalescence" (ELC) technology, offers many advantages over the conventional grinding method of producing toner particles. In this process, polymer particles having a narrow size distribution are obtained by forming a solution of a polymer in a solvent that is immiscible with water, dispersing the solution so formed in an aqueous medium containing a solid colloidal stabilizer, and removing the solvent. The resultant particles are then isolated, washed and dried.

In the practice of this technique, polymer particles are prepared from any type of polymer that is soluble in a solvent that is immiscible with water. The size and size distribution of the resulting particles can be predetermined and controlled by the relative quantities of the particular polymer employed, the solvent, the quantity and size of the water insoluble solid particulate suspension stabilizer, typically colloidal silica or latex, and the size to which the solvent-polymer droplets are reduced by mechanical shearing using rotor-stator type colloid mills, high pressure homogenizers, agitation etc.

Limited coalescence techniques of this type have been described in numerous patents pertaining to the preparation of electrostatic toner particles because such techniques typically result in the formation of polymer particles having a substantially uniform size distribution. Representative limited coalescence processes employed in toner preparation are described in U.S. Pat. Nos. 4,833,060 and 4,965,131 to Nair et al., incorporated herein by reference for all that they contain.

The electrostatographic toner particles obtained by either the conventional or the ELC process described above are substantially "solid," meaning that the particle interior is essentially continuous in terms of physical state as solid. On the other hand, if there are introduced pockets of gas (or vacuum) inside the particles the toner is then "porous."

There is a need to reduce the amount of toner applied to a substrate in the electrophotographic process (EP). Porous toner particles in the electrophotographic process can potentially reduce the toner mass in the image area. Simplistically, a toner particle with 50% porosity should require only half as much mass to accomplish the same imaging results. Hence, toner particles having an elevated porosity will lower the cost per page and decrease the stack height of the print as well. The application of porous toners provides a practical approach to reduce the cost of the print and improve the print quality.

U.S. Pat. Nos. 3,923,704; 4,339,237; 4,461,849; 4,489,174; and EP 0083188 discuss the preparation of multiple emulsions by mixing a first emulsion in a second aqueous phase to form polymer beads. These processes produce porous polymer particles having a large size distribution with little control over the porosity. This is not suitable for toner particle.

U.S. Pat. No. 7,368,212 describes a porous toner particle. However, control of particle size distribution along with the even distribution of pores throughout the particle is a problem.

US Patent Publication Numbers 2008/0176164 and 2008/0176157 disclose a method for the preparation of a porous toner particle by the steps of forming a first water-in-oil emulsion with a first aqueous phase comprising a pore stabilizing hydrocolloid dispersed in an organic phase containing a polymer; dispersing the first emulsion in a second aqueous phase to form a second emulsion by shearing in the presence of a stabilizing agent, to form droplets of the first emulsion in the second aqueous phase; and evaporating the organic solvent from the droplets to form porous toner particles. The method is based on the evaporative limited coalescence (ELC) process and produces porous particles of narrow particle size distribution and controlled porosity.

The process of obtaining porous toner particles through the ELC process, as disclosed in the above application, requires the formation of a multiple emulsion, or a water-in-oil-in-water (W1/O/W2) double emulsion, through a two-step homogenization process where the first high-shear step is needed to produce fine droplets of stabilized aqueous phase to form a first water-in-oil (W1/O) emulsion. The second homogenization step employs reduced shear to avoid destruction of the first emulsion. This is a common practice for double emulsion preparation. However, for production-scale preparation of double emulsions, the need for this first-emulsion preparation step demands additional capital equipment, more energy use, more complicated material handling, more waste due to the multiple steps, and thus higher manufacturing cost.

The high shear that is needed to form finely dispersed W1/O emulsion can lead to undesirable outcomes. Polymers of high molecular weight may be degraded by the high mechanical shear giving uncontrolled polymer composition in the final products. The high energy input also can generate heat during the homogenization, causing heat sensitive ingredients such as wax to melt and recrystallize, and temperature sensitive hydrocolloids to change form and property.

Another drawback in making a separate W1/O emulsion is that when the viscosity of the W1 phase is high, breaking down the W1 into small droplets becomes difficult. The emulsion is difficult to handle and disperse into the second water phase.

SUMMARY OF THE INVENTION

There is a need to simplify the manufacturing process of double emulsions in general, and of porous toner particles in particular, to reduce manufacturing cost. There is also a need to provide versatility to the process so that a wide range of porous toners can be easily prepared.

An object of the present invention is to provide a method of preparing a water-in-oil-in-water double emulsion through a one-step homogenization process.

A further object of the present invention is to provide porous polymeric particles through a simple one-step homogenization and solvent evaporation process.

A still further object of the present invention is to provide a simple process that produces porous particles reproducibly that have a narrow size distribution.

Still another object of the present invention is to more easily control pore size and pore size distribution within the porous particles.

These and other objectives can now be realized by the present invention by providing a less complex method to manufacture double emulsions and porous particles.

In accordance with one embodiment, the invention is directed towards a method of manufacturing a double emulsion with narrow dispersed phase particle size distribution comprising:

providing an organic phase comprising solid hydrocolloid particles dispersed in an organic solvent; and dispersing the organic phase in an aqueous phase in the presence of a controlled amount of stabilizing agent to form an emulsion of droplets of the organic phase dispersed in the external aqueous phase, wherein the hydrocolloid particles in the organic phase droplets are swelled with water from the external aqueous phase to form internal droplets of an aqueous phase in the organic phase droplets, thereby forming a double emulsion comprising droplets of the organic phase of controlled narrow particle size distribution in the external aqueous phase, where the organic phase droplets contain internal droplets of an aqueous phase.

The present invention further is directed towards a method for producing porous polymeric particles by such a double emulsion method, wherein the organic phase further comprises a polymer resin, and wherein the organic solvent is removed from the dispersed organic phase droplets to form porous toner particles.

BRIEF DESCRIPTION OF THE DRAWINGS

FIG. 1 is a Scanning Electron Micrograph (SEM) cross sectional image of a toner particle from Example 1 in accordance with an embodiment of the present invention;

FIG. 2 is an Optical Microscopic image of a dry toner sample from Example 3b) in accordance with an embodiment of the present invention;

FIG. 3 is an Optical Microscopic image of a dry toner sample from Example 4 in accordance with an embodiment of the present invention; and FIG. 4 is a Scanning Electron Micrograph (SEM) cross sectional image of a toner particle from Example 5 in accordance with an embodiment of the present invention.

For a better understanding of the present invention together with other advantages and capabilities thereof, reference is made to the following description and appended claims in connection with the preceding drawings.

DETAILED DESCRIPTION OF THE INVENTION

The use of porous toner particles in the electrophotographic process will reduce the toner mass in the image area. For example toner particles with 50% porosity should require only half as much mass to accomplish the same imaging results. Hence, toner particles having an elevated porosity will lower the cost per page and decrease the stack height of the print as well. The porous toner technology of the present invention provides a thinner image so as to improve the image quality, reduce curl, reduce image relief, save fusing energy and feel/look more close to offset printing rather than typical EP printing. In addition, colored porous particles of the present invention will narrow the cost gap between color and monochrome prints. Those potentials are expected to expand the EP process to broader application areas and promote more business opportunities for EP technology.

Porous polymer beads are used in various applications, such as chromatographic columns, ion exchange and adsorption resins, as drug delivery vehicles, scaffolds for tissue engineering, in cosmetic formulations, and in the paper and paint industries. Various methods for generating pores inside polymer particles are known in the field of polymer science. However, due to the specific requirements for the toner binder materials, such as suitable glass transition temperatures, crosslinking density and rheology, and sensitivity to particle brittleness that comes from enhanced porosity, the preparation of porous toners is not straightforward. In the present invention, porous particles are prepared using a multiple emulsion process, in conjunction with a suspension process, particularly, the ELC process.

The porous particles of the present invention include "micro," "meso," and "macro" pores which according to the International Union of Pure and Applied Chemistry are the classifications recommended for pores less than 2 nm, 2 to 50 nm, and greater than 50 nm respectively. The term porous particles will be used herein to include pores of all sizes, including open or closed pores.

The process for making the porous particles in accordance with one embodiment of this invention involves the following steps. The first step involves the formation of a suspension using dissolved polymer resin in an organic solvent and mixing with a finely dispersed solid form of a hydrocolloid. In the second step this suspension is dispersed into an aqueous phase containing a stabilizing agent and homogenized. The hydrocolloid particles in the organic phase dispersed droplets are swelled with water from the external aqueous phase to form internal droplets of an aqueous phase in the organic phase droplets, thereby forming a double emulsion comprising droplets of the organic phase of controlled narrow particle size distribution in the external aqueous phase, where the organic phase droplets contain internal droplets of an aqueous phase. The organic solvent is subsequently removed from the resulting double emulsion resulting in the formation of porous polymer particles, and the particles collected, washed, and dried.

It is pointed out in the text herein that the terms "double emulsion" and "multiple emulsion" both refer to W1/O/W2 or water-in-oil-in-water type emulsions, as is often found in open literature.

In the practice of this invention, suitable hydrocolloids include both naturally occurring and synthetic, water-soluble and water-swellable polymers as described in "Handbook of Hydrocolloids", Ed. G. O. Phillips; P. A. Williams, CRC Press LLC; Boca Raton, Fla., 2000. Particularly desirable hydrocolloids are those that swell upon contact with water. These include but not limited to many of the natural hydrogel materials, such as Agar-agar, Locust bean gum, Gum Arabic, Gum karaya, Gum tragacanth, Gum ghatti, Guar gum, Tara gum, Xanthan gum, Konjac, Gellan gum, as well as Alginates, Carrageenans, Pectin, Chitosan, etc. Other useful materials include cellulose derivatives e.g., carboxymethyl cellulose (CMC) also referred to as sodium carboxy methyl cellulose, hydroxyethyl cellulose (HEC), gelatin e.g., alkali-treated gelatin such as cattle bone or hide gelatin, or acid treated gelatin such as pigskin gelatin, gelatin derivatives e.g., acetylated gelatin, phthalated gelatin, and the like, substances such as proteins and protein derivatives. Synthetic polymeric hydrocolloids include poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, water soluble nano- and microgels, polyelectrolytes and mixtures thereof. Other synthetic polyelectrolytes hydrocolloids such as polystyrene sulphonate (PSS) or poly(2-acrylamido-2-methylpropanesulfonate) (PAMS) or polyphosphates are also possible hydrocolloids although they have strongly dissociating moieties.

The hydrocolloid may be incorporated into the organic suspension in the form of powders, from a composite material where the hydrocolloid is dispersed already in a solid or liquid polymeric composition, or from another separately prepared suspension or solid dispersion. In all of the sources for the hydrocolloid, water is substantially absent so that the hydrocolloid initially suspended in the organic phase is not in a dissolved, swollen, or softened state prior to dispersing the organic phase into the aqueous phase.

In order to obtain well dispersed hydrocolloid suspensions in the organic phase, the hydrocolloid is present in the organic suspension as separate particles with a size of about 1 nanometer to 10 micrometers, preferably in the range of about 1 nanometer to 5 micrometers, and more preferably in the size range of about 1 nanometer to 2 micrometers. Well known techniques to obtain fine powders or other dispersed forms of hydrocolloids can be used such as spray drying, lyophilizing, cryo-milling, melt compounding with polymer if heat melted, nano-gel particles preparation, nano-composite preparation, and nano-suspension preparation for example by precipitation. Other methods include the use of encapsulated powder, super absorbent polymers, and precipitated fine polymer crystals.

The hydrocolloids in finely dispersed form may contain other desired ingredients if so needed and allowed by the process that is used to obtain the hydrocolloid. Inorganic salts, soluble or insoluble in water, can be added. Dyes that can bind with the hydrocolloid, as another example, may be incorporated.

The organic phase may contain, in addition to the polymeric binder, appropriately selected surface active compounds to assist the dispersion of the hydrocolloid particles.

The hydrocolloid is generally used in an amount of 0.01% to 20% by weight relative to the polymer binder. However, depending upon the property of the hydrocolloid and its swelling properties and process conditions used, the use of the hydrocolloid may be minimized or maximized to obtain the desired particles and emulsions.

The essential properties of the hydrocolloids are solubility or swellability in water, no negative impact on multiple emulsification process, and no negative impact on melt rheology of the resulting particles when they are used as electrostatographic toners. The compounds can be optionally crosslinked in the pore to minimize migration to the surface affecting triboelectrification of the toners. The amount of the hydrocolloid used in the first step will depend on the amount of porosity and size of pores desired and the molecular weight of the hydrocolloid. A particularly preferred hydrocolloid is CMC and in an amount of from 0.01-20 weight percent of the binder polymer, preferably in an amount of from 0.1-10 weight percent of the binder polymer.

As indicated above, the present invention is applicable to the preparation of polymeric particles from any type of binder polymer or binder resin that is capable of being dissolved in a solvent that is immiscible with water wherein the binder itself is substantially insoluble in water. Useful binder polymers include those derived from vinyl monomers, such as styrene monomers, and condensation monomers such as esters and mixtures thereof. As the binder polymer, known binder resins are useable. Concretely, these binder resins include homopolymers and copolymers such as polyesters, styrenes, e.g. styrene and chlorostyrene; monoolefins, e.g. ethylene, propylene, butylene and isoprene; vinyl esters, e.g. vinyl acetate, vinyl propionate, vinyl benzoate and vinyl butyrate; α-methylene aliphatic monocarboxylic acid esters, e.g. methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers, e.g. vinyl methyl ether, vinyl ethyl ether and vinyl butyl ether; and vinyl ketones, e.g. vinyl methyl ketone, vinyl hexyl ketone and vinyl isopropenyl ketone. Particularly desirable binder polymers/resins include polystyrene resin, polyester resin, styrene/alkyl acrylate copolymers, styrene/alkyl methacrylate copolymers, styrene/acrylonitrile copolymer, styrene/butadiene copolymer, styrene/maleic anhydride copolymer, polyethylene resin and polypropylene resin. They further include polyurethane resin, epoxy resin, silicone resin, polyimide resin, modified rosin, paraffins and waxes. Also, especially useful are polyesters of aromatic or aliphatic dicarboxylic acids with one or more aliphatic diols, such as polyesters of isophthalic or terephthalic or fumaric acid with diols such as ethylene glycol, cyclohexane dimethanol and bisphenol adducts of ethylene or propylene oxides.

Preferably the acid values (expressed as milligrams of potassium hydroxide per gram of resin) of the polyester resins are in the range of 2-100. The polyesters may be saturated or unsaturated. Of these resins, styrene/acryl and polyester resins are particularly preferable.

In the practice of this invention, it is particularly advantageous to utilize resins having a viscosity in the range of 1 to 100 centipoise when measured as a 20 weight percent solution in ethyl acetate at 25° C.

Any suitable solvent that will dissolve the binder polymer and which is also immiscible with water may be used in the practice of this invention such as for example, chloromethane, dichloromethane, ethyl acetate, vinyl chloride, trichloromethane, carbon tetrachloride, ethylene chloride, trichloroethane, toluene, xylene, cyclohexanone, 2-nitropropane and the like. A particularly useful solvent in the practice of this invention are ethyl acetate and propyl acetate for the reason that they are both good solvents for many polymers while at the same time being sparingly soluble in water. Further, their volatility is such that they are readily removed from the discontinuous phase droplets as described below, by evaporation.

Optionally, the solvent that will dissolve the binder polymer and which is immiscible with water may be a mixture of two or more water-immiscible solvents chosen from the list given above. Optionally the solvent may comprise a mixture of one or more of the above solvents and a water-immiscible nonsolvent for the binder polymer such as heptane, cyclohexane, diethylether and the like, that is added in a proportion that is insufficient to precipitate the binder polymer prior to drying and isolation.

Various additives generally present in electrostatograhic toner may be added to the binder polymer prior to dissolution in the solvent, or after the dissolution step itself, such as colorants, charge control agents, and release agents such as waxes and lubricants.

Colorants, a pigment or dye, suitable for use in the practice of the present invention are disclosed, for example, in U.S. Reissue Pat. No. 31,072 and in U.S. Pat. Nos. 4,160,644; 4,416,965; 4,414,152; and 4,229,513. As the colorants, known colorants can be used. The colorants include, for example, carbon black, Aniline Blue, Calcoil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1 and C.I. Pigment Blue 15:3. Colorants can generally be employed in the range of from about 1 to about 90 weight percent on a total toner powder weight basis, and preferably in the range of about 2 to about 20 weight percent, and most preferably from 4 to 15 weight percent in the practice of this invention. When the colorant content is 4% or more by weight, a sufficient coloring power can be obtained, and when it is 15% or less by weight, good transparency can be obtained. Mixtures of colorants can also be used. Colorants in any form such as dry powder, its oil dispersions or wet cake can be used in the present invention. Colorant milled by any methods like media-mill or ball-mill can be used as well. The colorant may be incorporated in the oil phase separately or from a preformed masterbatch in an appropriate polymer, such as the binder.

Release agents may be used in toner to facilitate separation of fused images from the fuser roller. Preferably waxes are used herein and they are generally low-molecular weight polyolefins such as polyethylene, polypropylene and polybutene; silicone resins which can be softened by heating; fatty acid amides such as oleamide, erucamide, ricinoleamide and stearamide; vegetable waxes such as carnauba wax, rice wax, candelilla wax, Japan wax and jojoba oil; animal waxes such as bees wax; mineral and petroleum waxes such as montan wax, ozocerite, ceresine, paraffin wax, microcrystalline wax and Fischer-Tropsch wax; and modified products thereof. When a wax containing a wax ester having a high polarity, such as carnauba wax or candelilla wax, is used as the releasing agent, the amount of the wax exposed to the toner particle surface is inclined to be large. On the contrary, when a wax having a low polarity such as polyethylene wax or paraffin wax is used, the amount of the wax exposed to the toner particle surface is inclined to be small.

Irrespective of the amount of the wax inclined to be exposed to the toner particle surface, waxes having a melting point in the range of 30 to 150° C. are preferred and those having a melting point in the range of 40 to 140° C. are more preferred.

Wax is incorporated into the toner as fine particle, from about 0.1 to 1 micron in size. Preferably, the wax is incorporated in the organic phase from solid particle dispersions in an organic solvent, such as ethyl acetate. More preferably, the present invention utilizes wax dispersions such as those described in US Patent Publication No. 2007/0299191 or 2009/0286911, the disclosures of which are incorporated by reference in full herein.

The wax is, for example, 0.1 to 20% by mass, and preferably 1 to 10% by mass, based on the toner.

The term "charge control" refers to a propensity of a toner addendum to modify the triboelectric charging properties of the resulting toner. A very wide variety of charge control agents for positive charging toners are available. A large, but lesser number of charge control agents for negative charging toners, is also available. Suitable charge control agents are disclosed, for example, in U.S. Pat. Nos. 3,893,935; 4,079,014; 4,323,634; and 4,394,430; and British Patents 1,501,065 and 1,420,839. Charge control agents are generally employed in small quantities such as, from about 0.1 to about 5 weight percent based upon the weight of the toner. Additional charge control agents that are useful are described in U.S. Pat. Nos. 4,624,907; 4,814,250; 4,840,864; 4,834,920; 4,683,188; and 4,780,553. Mixtures of charge control agents can also be used.

The second step in the formation of the porous particles in accordance with an embodiment of this invention involves forming a water-in-oil-in-water emulsion by dispersing the above mentioned organic phase in an aqueous phase containing either stabilizer polymers such as poylvinylpyrrolidone or polyvinylalcohol or more preferably a particulate stabilizer such as colloidal silica such as LUDOX™ or NALCO™ or latex particles in a modified ELC process such as described in U.S. Pat. Nos. 4,833,060; 4,965,131; 2,934,530; 3,615,972; 2,932,629; and 4,314,932, the disclosures of which are hereby incorporated by reference.

Specifically, in the second step of the process of the present invention, the organic or oil phase is mixed with an aqueous phase containing a controlled amount of a particulate stabilizer, such as colloidal silica, to form an aqueous suspension of droplets that is subjected to shear or extensional mixing or similar flow processes, preferably through an orifice device to reduce the droplet size, and achieve narrow size distribution droplets through the limited coalescence process. The pH of the aqueous phase is generally between 4 and 7 when using silica as the colloidal stabilizer.

The suspension that is the organic phase, when dispersed in the aqueous phase, preferably with mild agitation, results in droplets of binder polymer/resin dissolved in oil containing the hydrocolloid as swollen droplets within the bigger binder polymer/resin droplets. This leads to the formation of a water-in-oil-in-water double emulsion, which is then further homogenized through an orifice device. Upon removal of the solvent and drying, the emulsion produces porous domains in the resultant particles of binder polymer/resin as shown, for example, in FIG. 1. The actual amount of silica used for stabilizing the droplets depends on the size of the final porous particle desired as with a typical limited coalescence process, which in turn depends on the volume and weight ratios of the various phases used for making the multiple emulsion.

For the emulsion making step, where the water-in-oil-in-water emulsion is formed, the shear or extensional mixing or flow process is controlled in order to prevent disruption of the hydrocolloid containing droplets. Size reduction is achieved by homogenizing the emulsion through a capillary orifice device, or other suitable flow geometry. In the method of this invention, the range of back pressure suitable for producing acceptable particle size and size distribution is between 100 and 3000 psi, preferably between 500 and 2000 psi. The preferable flow rate is between 500 and 6000 mL per minute, but will depend on the scale and capacity in place.

The final size of the particle, the final size of the pores and the surface morphology of the particle may be impacted by the osmotic mismatch between the osmotic pressure of the inner water phase that forms when water phase is introduced, the binder polymer/resin oil phase and the outer water phase in the resultant double emulsion. At each interface, the larger the osmotic pressure gradient present, the faster the diffusion rate where water will diffuse from the lower osmotic pressure phase to the higher osmotic pressure phase depending on the solubility and diffusion coefficient of the water in oil phase. If either the exterior water phase or the interior water phase has an osmotic pressure less than the oil phase then water will diffuse into and saturate the oil phase. For the preferred oil phase solvent of ethyl acetate this can result in approximately 8% by weight water dissolved in the oil phase. If the osmotic pressure of the exterior water phase is higher than the binder phase then the water will migrate out of the pores of the particle and reduce the porosity and particle size. In order to maximize porosity one preferably orders the osmotic pressures so that the osmotic pressure of the outer phase is lowest, while the osmotic pressure of the interior water phase is highest. Thus the water will diffuse following the osmotic gradient from the external water phase into the oil phase and then into the internal water phase swelling the size of the pores and increasing the porosity and particle size.

If it is desirable to have small pores and maintain small drop size, then the osmotic pressure of both the interior and exterior water phase should be preferably matched, or have a small osmotic pressure gradient. It is also preferable that the osmotic pressure of the exterior and interior water phases be higher than the oil phase. When using weakly dissociating hydrocolloids such as CMC, one can change the pH of the exterior water phase using acid or a buffer preferably a pH 4 citrate-phosphate buffer. The hydrogen and hydroxide ions may diffuse rapidly into the interior water phase and equilibrate the pH with the exterior phase. A drop in pH of the interior water phase containing the CMC thus reduces the osmotic pressure of the CMC. By designing the equilibrated pH correctly one can control the hydrocolloid osmotic pressure and thus the final porosity, size of the pores and particle size.

One way to control the surface morphology as to whether there are open pores (surface craters) or closed pores (a surface shell) is by controlling the osmotic pressure of the two water phases. If the osmotic pressure of the interior water phase is sufficiently low relative to the exterior water phase the pores near the surface may burst to the surface and create an "open pore" surface morphology during drying in the third step of the process.

The third step in the preparation of the porous particles of this invention involves removal of the solvent that is used to dissolve the binder polymer leaving a suspension of uniform porous polymer particles in aqueous solution. The temperature and pressure conditions for and thus the rate of solvent removal will impact the final particle size and surface morphology. Clearly the details of the importance of this process depend on the water solubility and boiling point of the organic phase relative to the temperature and pressure of the process. Solvent removal apparatus such as a rotary evaporator or a flash evaporator may be used in the practice of the method of this invention.

Alternatively, in the practice of another embodiment of the present invention, the solid hydrocolloid may be suspended in an organic phase comprising water-immiscible polymerizable monomers, a polymerization initiator and optionally a colorant, a release agent, and a charge control agent, and the organic phase emulsified with an aqueous phase comprising solid stabilizer particles to form a limited coalescence (LC) multiple emulsion. The monomers in dispersed droplets of the organic phase in the emulsified mixture are polymerized, preferably through the application of heat or radiation. The resulting suspension polymerized particles may be isolated and dried as described earlier to yield porous particles.

Useful monomers for this LC polymerization process include vinyl monomers, such as styrene; vinyl esters, e.g. vinyl acetate, vinyl propionate, vinyl benzoate and vinyl butyrate; vinyl ethers, e.g. vinyl methyl ether, vinyl ethyl ether and vinyl butyl ether; and vinyl ketones, e.g. vinyl methyl ketone, vinyl hexyl ketone and vinyl isopropenyl ketone; and mixtures thereof. Particularly desirable monomers include styrene, mixtures of styrene/alkyl acrylate, styrene/alkyl methacrylate, styrene/acrylonitrile, styrene/maleic anhydride. Styrene/acryl mixtures are particularly preferable.

The polymer particles are isolated after removing the solvent by filtration or centrifugation, followed by drying in an oven at 40° C. that also removes any water remaining in the pores from the first water phase. Optionally, the particles are treated with alkali to remove the silica stabilizer.

Optionally, the third step in the preparation of porous particles described above may be preceded by the addition of additional water prior to removal of the solvent, isolation and drying. In this regard, it is preferable to use a high osmotic aqueous phase to form the emulsion, where the initial swelling of the hydrocolloid is limited, and then dilute the so formed double emulsion with external water to increase the swelling and obtain desired porosity in the resultant particles.

The average particle diameter of the porous toner of the present invention is, for example, 2 to 50 micrometers, preferably 3 to 20 micrometers.

The porosity of the particles is greater than 5%, preferably greater than 10%.

The shape of the toner particles has a bearing on the electrostatic toner transfer and cleaning performance. Thus, for example, the transfer and cleaning efficiency of toner particles have been found to generally improve as the sphericity of the particles are reduced. A number of procedures to control the shape of toner particles are known in the art. In the practice of this invention, additives may be employed in the water phase or in the oil phase if necessary. The additives may also be added after forming the water-in-oil-in-water emulsion. In either case the interfacial tension is modified as the solvent is removed resulting in a reduction in sphericity of the particles. U.S. Pat. No. 5,283,151 describes the use of carnauba wax to achieve a reduction in sphericity of the particles. US Patent Publication No. 2008/0145779 describes the use of certain metal carbamates that are useful to control sphericity and US Patent Publication No. 2008/0145780 describes the use of specific salts to control sphericity. Other useful shape control agents can be advantageously employed including those disclosed in U.S. Pat. Nos. 6,380,297; 6,416,921; and 6,482,562; and US Patent Publication No. 2007/0298346, the disclosures of which are incorporated by reference herein.

The present invention is suited for a continuous manufacturing process and such a process can further provide controls over the time intervals between steps of mixing, and homogenization, and optional dilution, and solvent removal. For example, depending on the swelling property (kinetics, swelling capacity) and emulsion stabilizing effect of the specific hydrocolloid used, the time interval between homogenization (or optional dilution) and solvent removal can be varied to affect porosity and pore size in the porous particles.

In an alternative embodiment of the present invention, the organic phase mixture may be composed of the hydrocolloid particles, water-immiscible polymerizable monomers, a polymerization initiator and optionally a colorant and a charge control agent. This may then be dispersed in water containing stabilizer as described in the second step of the process to form a water-in-oil-in-water emulsion preferably through the limited coalescence process. The monomers in the emulsified mixture are polymerised in a third step, preferably through the application of heat or radiation. The resulting suspension polymerized particles may be isolated and dried as described earlier to yield porous particles. In addition the mixture of water-immiscible polymerizable monomers can contain the binder polymers listed previously.

Toner particles of the present invention may also contain flow aids in the form of surface treatments. Surface treatments are typically in the form of inorganic oxides or polymeric powders with typical particle sizes of 5 nm to 1000 nm. With respect to the surface treatment agent also known as a spacing agent, the amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 10 weight percent, and most preferably from about 0.1 to about 5 weight percent, based on the weight of the toner.

The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention.

The preferred spacing agent is silica, such as those commercially available from Degussa, like R-972, or from Wacker, like H2000. Other suitable spacing agents include, but are not limited to, other inorganic oxide particles, polymer particles and the like. Specific examples include, but are not limited to, titania, alumina, zirconia, and other metal oxides; and also polymer particles preferably less than 1 μm in diameter (more preferably about 0.1 μm), such as acrylic polymers, silicone-based polymers, styrenic polymers, fluoropolymers, copolymers thereof, and mixtures thereof.

The present invention will further be illustrated by the following examples. They are not intended to be exhaustive of all possible variations of the invention.

Kao Binder E and Kao Binder N, both polyester resins, used in the examples below were obtained from Kao Specialties Americas LLC, a part of Kao Corporation, Japan. Carboxymethyl cellulose (CMC) molecular weight approximately 250,000 and degree of substitution of 0.9 was obtained from Sigma-Aldrich, Inc., St. Louis, Mo., as the sodium salt. CMC molecular weight 250,000 and degree of substitution of 0.7, as sodium salts, was obtained from Acros Organics. Hydroxyethyl cellulose (HEC), high viscosity, was from Fluka BioChemika. The cyan pigment used in the Examples of this invention was Sunfast Blue pigment from SunChemical, which is Pigment Blue 15:3 flushed and dispersed at 40% loading in a linear copolymer of fumaric acid and Bisphenol A. Alternatively, the pigment itself was milled in ethyl acetate in the presence of hyperdispersant dispersing aids to give solid particle dispersions that can be used to form the oil phase. An ester wax WE-3 used as releasing agent was obtained from NOF Corporation, Japan. NALCO™ 1060, a colloidal silica, was obtained from Nalco Company as a 50 weight percent dispersion. Buffer of pH value of 4.0 was prepared using citric acid and sodium phosphate dibasic, both available from Sigma. Poly(2-ethyl-2-oxazoline), or PEOX, with MW of 50,000 was from Aldrich.

The size and shape of the particles were measured using a Sysmex FPIA-3000 automated particle shape and size analyzer from Malvern Instruments. Samples pass through a sheath flow cell that transforms the particle suspension into a narrow or flat flow, ensuring that the largest area of the particle is oriented towards the camera and that all particles are in focus. The CCD camera captures 60 images every second and these are analyzed in real time. Numerical evaluation of particle shape is derived from measurement of the area of the particle. A number of shape factors are calculated including circularity, aspect ratio and circle equivalent diameter.

The particle size distribution was characterized by a Coulter Particle Analyzer. The volume median value from the Coulter measurements was used to represent the particle size of the particles described in these examples.

The extent of porosity of the particles of the present invention can be visualized using a range of microscopy techniques. Conventional Scanning Electron Microscope (SEM) imaging was used to image fractured samples and view the inner pore structure. The SEM images give an indication of the porosity of the particles but are not normally used for quantitative determination. The level of porosity of the particles of the present invention was measured using mercury intrusion method.

The determination of the extent of particle porosity can be problematic. Determining particle porosity using typical gravitational methods can be problematic due to the size and distribution of pores in the particles and whether or not some pores break through to the particle surface. To accurately determine the extent of porosity in the particles of the present invention a combination of conventional diameter sizing and time-of-flight methods could be used. Conventional sizing methods include total volume displacement methods such as Coulter particle sizers or image based methods such as the Sysmex FPIA3000 system. The time-of-flight method used to determine the extent of porosity of the particles in the present invention includes the Aerosizer particle measuring system. The Aerosizer measures particle sizes by their time-of-flight in a controlled environment. This time of flight depends critically on the density of the material. If the material measured with the Aerosizer has a lower density due to porosity or a higher density due, for example, to the presence of fillers, then the calculated diameter distribution will be shifted artificially low or high respectively. Independent measurements of the true particle size distribution via alternate methods (e.g. Coulter or Sysmex) can then be used to fit the Aerosizer data with particle density as the adjustable parameter. The method of determining the extent of particle porosity of the particles of the present invention is as follows. The outside diameter particle size distribution is first measured using either the Coulter or Sysmex particle measurement systems. The mode of the volume diameter distribution is chosen as the value to match with the Aerosizer volume distribution. The same particle distribution is measured with the Aerosizer and the apparent density of the particles is adjusted until the mode of the two distributions matches. The ratio of the calculated and solid particle densities can be taken to be the extent of porosity of the particles.

EXAMPLE 1

An organic phase was prepared using Kao N and a suspension of CMC (250 K) in Kao N in ethyl acetate to give a total 75.0 g of oil phase containing about 15.4 g polymer Kao N and about 0.046 g of CMC (particle size ~0.30±0.07 microns), and this organic phase is mixed with an aqueous phase containing 121.1 g of citrate-phosphate pH 4 buffer (200 mM), 2.9 g of Nalco 1060, and 2.0 g of $KNO_3$. The mixture was pre-mixed with a Silverson L4R mixer equipped with a large-hole disintegration head at 2100 RPM for about 1.5 min. The pre-mix was then passed through an orifice device with an opening of 0.53 mm at a back pressure of about 650 psi. The resulting emulsion was collected and diluted with an amount of water three times the weight of the emulsion. The solvent was then removed under vacuum on a rotary evaporator. The particles were then collected by filtration. An SEM image of the sample containing some freeze-fractures particles is given in FIG. 1.

EXAMPLE 2

An organic phase was prepared using the suspension of CMC in Kao N solution from Example 1, Kao N polymer resin, and SunChemical Sunfast blue masterbatch to give a total of 87.0 g of a mixture containing about 17.52 g of Kao N, 0.80 g of Pigment Blue 15:3, and about 0.045 g of CMC and 1.2 g of polyester resin that came with the pigment. After stirring overnight, 75.0 g of the organic phase is mixed with an aqueous phase containing 119.2 g of citrate-phosphate pH 4 buffer (200 mM), and 5.8 g of Nalco 1060. The mixture was pre-mixed with a Silverson L4R mixer equipped with a large-hole disintegration head at 1600 RPM for about 1.5 min. The pre-mix was then passed through an orifice device with an opening of 0.53 mm at a back pressure of about 750 psi. The resulting emulsion was collected and diluted with an amount of PEOX-containing (0.03%) water equal to the weight of the emulsion. The solvent was then removed under vacuum on a rotary evaporator. The particles were then collected by filtration, and shown by Coulter measurement to have a volume based median diameter of 12.2 microns, and by Sysmex a mean aspect ratio (W/L) of 0.817 which is indicative of irregular shape of the particles.

EXAMPLE 3

An organic phase was prepared using the suspension of CMC in Kao N solution from Example 1, Kao N in ethyl acetate (23.4% by weight), ethyl acetate solvent, SunChemical Sunfast blue masterbatch, and a WE-3 wax dispersion (13.18% by weight) to form a total of 85.0 g of a mixture containing 1.20 g of Pigment Blue 15:3, 1.35 g of WE-3, 12.90 g of Kao N, and 1.80 g of polyester resin that came as dispersant for the pigment. After stirring overnight, 80.25 g of the organic phase is mixed with an aqueous phase containing 128.8 g of citrate-phosphate pH 4 buffer (200 mM), and 6.23 g of Nalco 1060. The mixture was pre-mixed with a Silverson L4R mixer equipped with a large-hole disintegration head at 2000 RPM for about 1.5 min. The pre-mix was then passed through an orifice device with an opening of 0.53 mm at a back pressure of about 950 psi. The resulting emulsion was collected and divided into three parts: a) was diluted with an amount of PEOX-containing (0.03%) water equal to the weight of the emulsion; b) was diluted with an amount of water equal to the weight of the emulsion; and c) was not diluted. The solvent was then all separately removed under vacuum on a rotary evaporator for the three samples. The particles were then collected by filtration, and results of particle analysis are shown in the Table below for the irregular shaped a) and b) samples. The use of PEOX in sample a) caused more irregularity in the particles as indicated by the lower mean aspect ratio. In addition, both samples had narrow particle size distributions. An optical micrograph (FIG. 2) showed the presence of pores in the b) particles.

| Example 3 | Diameter, volume-based median, microns | Mean Aspect ratio (W/L) |
|---|---|---|
| a) | 7.91 | 0.794 |
| b) | 7.69 | 0.859 |

EXAMPLE 4

An organic phase (total 85.0 g) was prepared using a suspension of Hydroxyethylcellulose (high viscosity) from Fluka BioMedika in a Kao N solution (0.057% by weight, particle size<0.1 microns), and contained 13.12 g of Kao N, about 0.015 g of HEC, 1.20 g of Pigment Blue 15:3, 1.80 g of polyester resin that came with the pigment, 1.35 g of WE-3 wax (0.44 um in particle size), and 6.75 g of ethyl acetate solvent. From this organic phase, 83.0 g was taken and added to an aqueous phase containing 126.9 g of a pH 4 citrate-phosphate buffer and 8.1 g of Nalco 1060 with stirring at 2000 RPM by a Silverson L4R Mixer fitted with a large-hole disintegration head. After 1.0 min, the pre-mix was passed through an orifice device with an opening of 0.53 mm at a back pressure of about 820 psi. The resulting emulsion was collected and diluted with an amount of PEOX-containing (0.03%) water equal to the weight of the emulsion (1:1 dilution). The solvent was then removed under vacuum on a rotary evaporator. The particles were then collected by filtration. Analysis using the Sysmex FPIA3000 system showed a volume based median diameter of 6.6 microns, and an aspect ratio (W/L) of about 0.890, indicating that the particles have irregular shape. FIG. 3 is an optical image of the dried sample of the obtained porous particles.

EXAMPLE 5

An organic phase was prepared using 47.5 g of a Kao Binder E solution (21.06% in EtOAc) and 2.52 g of ethyl acetate into which was mixed a dry powder of CMC (250,000, DS 0.9) that had passed through a mesh 635 sieve (0.300 g). This organic phase was stirred magnetically, and then quickly added to an aqueous phase containing 79.6 g of a pH 4 phosphate-citrate buffer, 5.43 g of Nalco 1060, and 3.8 g of $KNO_3$ salt while being stirred with a Silverson L4R Mixer fitted with the large hole disintegration head at 2200 rpm. After 5 seconds, the resulting multiple emulsion was diluted three-fold with water, and the solvent was removed on a rotary evaporator. The particles were collected and porous particles were observed by microscopy and by SEM imaging (FIG. 4) on freeze fractured samples.

The invention has been described in detail with particular reference to certain preferred embodiments thereof, but it will be understood that variations and modifications can be effected within the spirit and scope of the invention.

The invention claimed is:

1. A method of manufacturing a double emulsion with narrow dispersed phase particle size distribution comprising:

providing an organic phase comprising solid hydrocolloid particles dispersed in an organic solvent; and dispersing the organic phase in an aqueous phase in the presence of a controlled amount of stabilizing agent to form an emulsion of droplets of the organic phase dispersed in the external aqueous phase, wherein the hydrocolloid particles in the organic phase droplets are swelled with water from the external aqueous phase to form internal droplets of an aqueous phase in the organic phase droplets, thereby forming a double emulsion comprising droplets of the organic phase of controlled narrow particle size distribution in the external aqueous phase, where the organic phase droplets contain internal droplets of an aqueous phase.

2. The method of claim 1 wherein the hydrocolloid is selected from the group consisting of carboxymethyl cellulose (CMC), hydroxyethyl cellulose (HEC), gelatin, alkali-treated gelatin, acid treated gelatin, gelatin derivatives, proteins, protein derivatives, synthetic polymeric binders, water soluble microgels, polystyrene sulphonate, poly(2-acrylamido-2-methylpropanesulfonate) and polyphosphates.

3. The method of claim 1 wherein the hydrocolloid is carboxymethyl cellulose or hydroxyethyl cellulose.

4. The method of claim 1 wherein the stabilizing agent comprises poylvinylpyrrolidone, polyvinylalcohol, colloidal silica or latex particles.

5. The method of claim 1 wherein the stabilizing agent comprises colloidal silica or latex particles.

6. The method of claim 1, wherein the organic phase further comprises a polymer, and further comprising a step of evaporating the organic solvent from the dispersed organic phase droplets to form porous polymer particles.

7. The method of claim 6 further comprising isolating the polymer particles.

8. The method of claim 7 further comprising drying the polymer particles.

9. The method of claim 6 wherein the polymer comprises a polymer formed from at least one of vinyl monomers, condensation monomers, condensation esters and mixtures thereof.

10. The method of claim 6 wherein polymer is selected from the group consisting of polyesters, styrenes, vinyl ethers and vinyl ketones.

11. The method of claim 6 wherein polymer is a polyester.

12. The method of claim 6 wherein the hydrocolloid is selected from the group consisting of carboxymethyl cellulose (CMC), hydroxyethyl cellulose (HEC), gelatin, alkali-treated gelatin, acid treated gelatin, gelatin derivatives, proteins, protein derivatives, synthetic polymeric binders, water soluble microgels, polystyrene sulphonate, poly(2-acrylamido-2-methylpropanesulfonate) and polyphosphates.

13. The method of claim 6 wherein the hydrocolloid is carboxymethyl cellulose or hydroxyethyl cellulose.

14. The method of claim 6 wherein the stabilizing agent comprises poylvinylpyrrolidone, polyvinylalcohol, colloidal silica or latex particles.

15. The method of claim 6 wherein the stabilizing agent comprises colloidal silica or latex particles.

16. The method of claim 6 wherein the aqueous phase further comprises buffering salts or electrolyte ions.

17. The method of claim 6 wherein the organic solvent comprises ethyl acetate, propyl acetate, chloromethane, dichloromethane, vinyl chloride, trichloromethane, carbon tetrachloride, ethylene chloride, trichloroethane, toluene, xylene, cyclohexanone or 2-nitropropane.

18. The method of claim 6 wherein prior to evaporating the organic solvent, additional water is added to the emulsion.

19. The method of claim 6 wherein the organic phase further comprises at least one of colorants, waxes and charge control agents.

20. The method of claim 6 wherein the polymer particles are toner particles.

* * * * *